United States Patent [19]

Kominami et al.

[11] 3,993,885

[45] Nov. 23, 1976

[54] PAN DETECTOR FOR AN INDUCTION HEATING APPARATUS

[75] Inventors: Hideyuki Kominami; Keizo Amagami; Yukio Hirai; Tadao Toyooka, all of Kodama, Japan

[73] Assignee: Matsushita Electric Industrial Co., Ltd., Japan

[22] Filed: Jan. 28, 1975

[21] Appl. No.: 544,844

[30] Foreign Application Priority Data

Feb. 4, 1974 Japan ..... 49-14816

[52] U.S. Cl. ..... 219/10.49; 219/10.75; 335/207

[51] Int. Cl.[2] ..... H05B 5/04

[58] Field of Search..... 219/10.49, 10.77, 10.75, 219/518; 335/205, 206, 207, 295, 301, 219; 200/12, 19 M; 336/DIG. 3, 110

[56] References Cited

UNITED STATES PATENTS

| | | | |
|---|---|---|---|
| 2,497,753 | 2/1950 | Arnot | 219/10.49 |
| 3,710,062 | 1/1973 | Peters | 219/10.49 |
| 3,796,850 | 3/1974 | Moreland et al. | 219/10.49 |
| 3,821,509 | 1/1974 | Amagami et al. | 219/10.49 |
| 3,829,803 | 8/1974 | Maedu | 335/205 |

*Primary Examiner*—Bruce A. Reynolds
*Attorney, Agent, or Firm*—Robert E. Burns; Emmanuel J. Lobato; Bruce L. Adams

[57] ABSTRACT

A pan detector for an induction heating apparatus of the type having an induction heating coil adapted to electromagnetically couple to a cooking vessel comprises a first, vertically movable magnet and a second, fixed magnet spaced therefrom and a reed switch disposed between the first and second magnets. Upon the placement of a cooking vessel of magnetic metal in overlying relation to the heating coil, the first magnet moves upwardy by attraction between the bottom wall of the cooking vessel and the first magnet to result in a change in magnetic flux level in the neighborhood of the reed switch. The reed switch operates in response to the change in magnetic flux level to permit and prevent, respectively, energization of the heating coil. The first and second magnets have their poles oriented in opposition to each other to provide repulsion therebetwen to increase the attraction.

3 Claims, 3 Drawing Figures

PAN DETECTOR FOR AN INDUCTION HEATING APPARATUS

The present invention relates generally to induction heating cooking apparatus, and in particular to a pan detector incorporated in an induction heating apparatus for detecting the presence and absence of a pan load of magnetic metal.

U.S. Pat. No. 3,821,509, issued to K. Amagami et al. and assigned to the same assignee as the present invention, discloses an induction heating apparatus in which cooking utensil is heated by eddy currents induced therein by changing magnetic fields.

However, use has widely been made of utensils made of non-magnetic metal such as aluminum for cooking purposes. If the operator inadvertently places such nonmagnetic utensil over the source of alternating magnetic flux, the load impedance will abruptly change to such a degree that undesirable consequences (such as abnormal oscillation of inverter circuit, an overcurrent in the induction heating coil and misfiring of solid state switching element) will occur.

An object of the present invention is therefore to initiate energization of the heating coil only when the presence of a proper load is placed in overlying relation thereto to thereby prevent the undesirable consequences encountered in the past.

Another object of the invention is to provide a pan detector which detects the presence of the proper load by the movement of a permanent magnet placed adjacent thereto to operate a switch in response to the movement of the magnet.

A further object of the invention is to provide a pan detector in which an upper movable magnet and a lower fixed magnet are located below the heating coil in vertically spaced-apart relation to effect repulsion therebetween to substantially cancel the weight of the upper magnet to increase attraction between it and the bottom wall of the load.

Other objects and features of the present invention will be understood from the following description taken in conjunction with the accompanying drawings, in which.

Briefly, in accordance with the present invention, the pan detector assembly of the invention is incorporated in an induction heating apparatus of the type including an induction heating coil which is adapted to be coupled electromagnetically to a cooking vessel placed in overlying relation to the heating coil and a static power conversion, or inverter circuit which supplies the coil with an ultrasonic frequency energization current. Essentially, the pan detector comprises a permanent magnet vertically movably supported underneath the cooking vessel and a switch disposed adjacent the magnet to be actuated in response to the vertical movement of the magnet. In a preferred embodiment, the pan detector comprises an upper movable magnet located adjacent the bottom wall of the cooking vessel and a lower fixed magnet spaced therefrom. These magnets have their poles oriented in opposition to each other to produce repulsion therebetween to substantially cancel the weight of the upper magnet. A magnetic reed switch having a pair of magnetically sensitive leaf contacts is located intermediate the upper and lower magnets. Upon placement of the cooking vessel of magnetic metal, the upper magnet will be moved upward due to the attraction between the bottom wall of the vessel and the upper magnet and as a result the level of magnetic flux in the neighborhood of the reed switch lowers. The reduction in the level of magnetic flux will result in the operation of the reed switch which permits and prevents energization of the induction heating coil.

Figure 1:
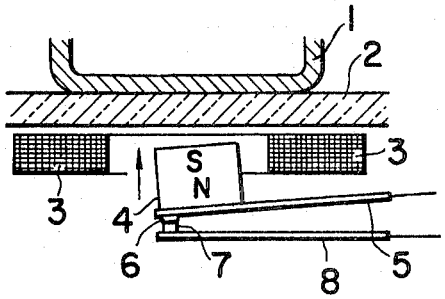
FIG. 1 is a schematic view illustrating the essential feature of the invention.

Referring now to FIG. 1, the essential feature of the present invention is schematically illustrated. A cooking vessel or pan 1 of a magnetic metal such as iron or stainless steel is located on a cooking plate 2 of a ceramic material in overlying relation to an induction heating coil 3 mounted, underneath the cooking plate 2 by suitable means not shown herein. A permanent magnet 4 is mounted movably relative to the bottom wall of the pan 1 on one end of a switch arm 5 having a contact 6 which is normally in engagement with a contact 7 of arm 8. The switch arms are suitably connected to the circuit which energizes the coil 3 to permit and prevent energization of the induction heating coil. Upon placement of the pan 1, the magnet 4 will be moved upwardly by attraction between the bottom wall of the pan load 1 and the magnet and the contacts 6, 7 are moved out of engagement. The switching of the contacts is utilized in a suitable manner to control switching of the energization of coil 3.

Figure 2:
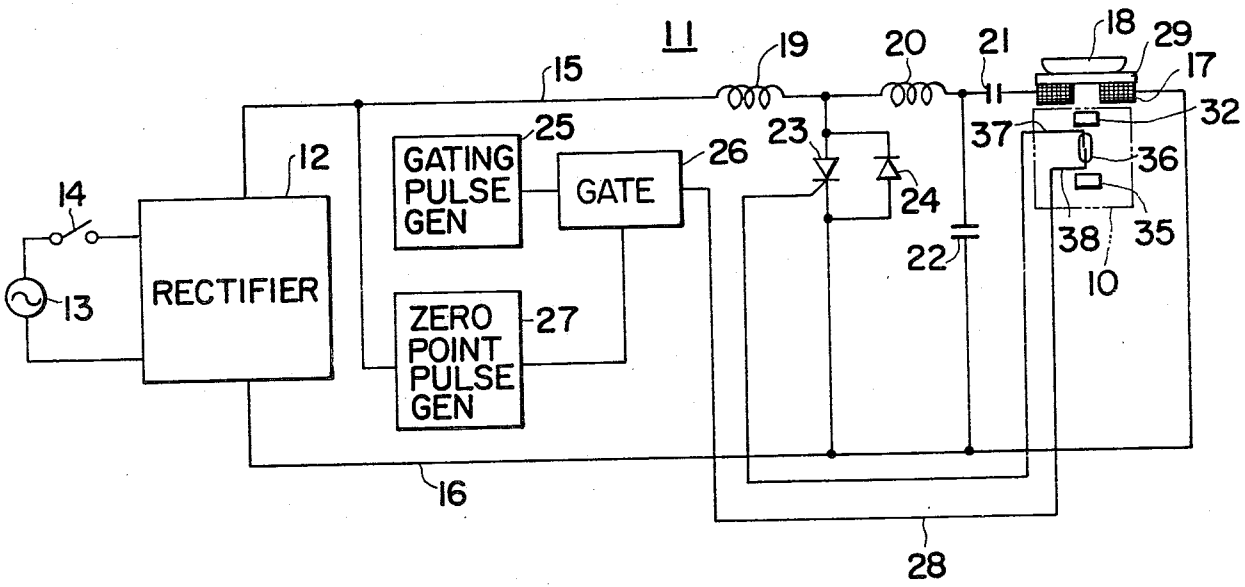
FIG. 2 is a schematic circuit block diagram of an induction heating apparatus incorporating a pan detector of the invention.

Referring to FIG. 2, a pan detector 10 in a preferred form of the present invention is shown incorporated in an induction heating apparatus 11 of the type which comprises a full wave rectifier 12 coupled to a commercial or residential alternating current power supply 13 through turn-on switch 14 to supply a full wave rectified unfiltered unidirectional voltage to a pair of terminals or buses 15 and 16, an induction heating coil 17 which couples electromagnetically to a saucepan 18 placed over the coil 17, a static power conversion, or chopper inverter circuit comprised of a filter inductor 19, a commutating inductor 20, a filter capacitor 21, a commutating capacitor 22 and a silicon-controlled rectifier 23 and a feedback diode 24 connected in inverse parallel relation thereto. A gating pulse generator 25 is provided to excite the silicon-controlled rectifier 23 at an ultrasonic frequency. A soft starting zero point switching device or gate 26 is connected to the pulse generator 25 to pass the gating pulses to the silicon-controlled rectifier 23 when rendered conductive by a zero point sensing and pulse generating circuit 27. The details of the zero point sensing and pulse generating circuit 27 are described in the aforementioned U.S. Pat. No. 3,821,509 in connection with the embodiment of FIG. 4 thereof. The zero point sensing and pulse generating circuit 27 is connected to the bus 15 to sense the zero voltage point of the full wave rectified unfiltered voltage appearing on the bus 15 to produce a gate pulse at each zero voltage point occurring intermediate each half sinusoidal wave pulse. The switching device 26, once enabled by the gate pulse, passes gating pulses derived from circuit 25 to the silicon-controlled rectifier 23 through circuit 28.

Figure 3:
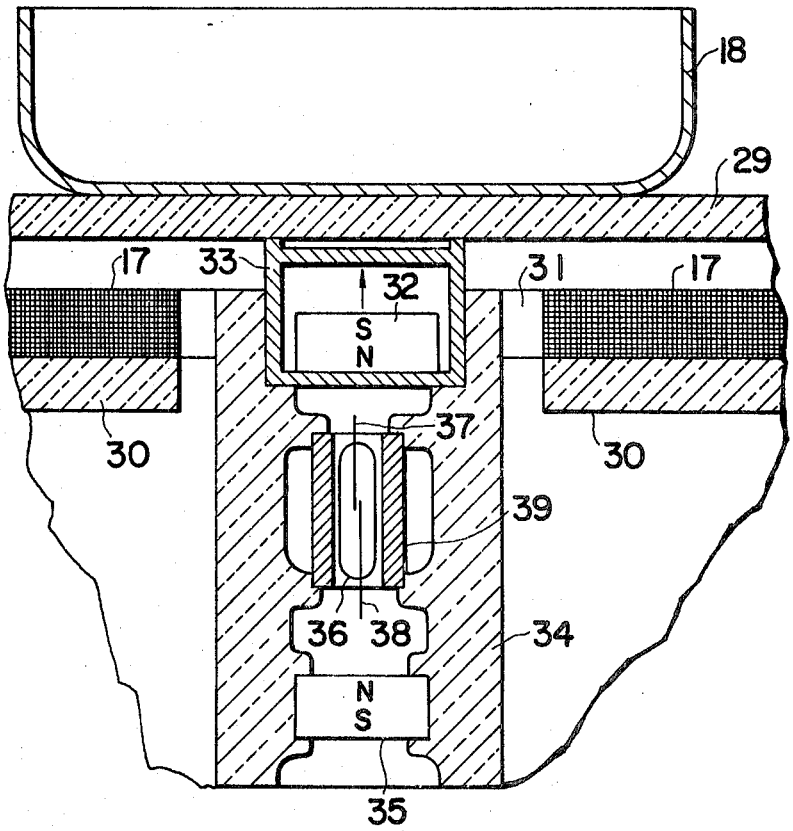
FIG. 3 is a view of vertical cross section showing the relationship between the cooking vessel on the cooking surface, the induction heating coil and the pan detector assembly.

Incorporation of the arrangement of the pan detector 10 of the preferred embodiment is best understood in connection with FIG. 3. A refractory material such as a glass ceramic sheet 29 provides a cooking surface above the induction heating coil 17. The heating coil 17 may comprise wire wound in a spiral to form a central bore 31 therein and moulded in a rubber compound to hold the wire in place with proper spacing between successive convolutions and is supported from below by a block 30 which is supported by means not shown herein. A first permanent magnet 32 is vertically movably disposed within a sealed metal housing 33 of non-magnetic material located in the bore 31 of the coil 17. The housing 33 is supported by a moulded block 34 which is supported on the base plate not shown herein. The block 34 is provided with a central bore extending therethrough and having portions of varying diameter with shoulder portions therebetween. The housing 33 is received in the upper end of the block 34 with its top wall in contact with the underside of the ceramic top plate 29. A second permanent magnet 35 is located below the first magnet 33 at a predetermined spacing therefrom. The first and second magnets 32, 35 have their poles oriented in opposition to each other such that magnetic repulsion therebetween is sufficient to substantially cancel the weight of the first magnet 32. Switch means in the form of a sealed, magnetic reed switch 36 having leaf contacts 37 and 38 is vertically disposed intermediate the first and second magnets and suitably supported within a magnetic shield 39 which is, for example, in cylindrical form. A metal of high magnetic properties may also be used as a shielding material. The leaf contacts 37 and 38 are connected in the circuit 28 and normally disengaged from contact with each other under the influence of the magnetic flux of the upper magnet 32 to disconnect the circuit 28. When saucepan 18 of a magnetic metal is properly located on the ceramic plate 29 in overlying relation to the heating coil 17, the first magnet 32 will be drawn upwardly as indicated by the arrow to the cooking vessel 18 by attraction between the bottom wall of the vessel 18 and the magnet 32. The change in magnetic flux level in the neighborhood of the reed switch 36 will cause the leaf contacts 37 and 38 to attract each other into engagement to thereby complete the circuit 28. This permits gating pulses to be applied through reed switch 36 to the control electrode of the silicon-controlled rectifier 23.

Upon application of gating pulses, the silicon-controlled rectifier 23 is excited to generate in the inverter circuit an ultrasonic frequency wave energization current which energizes the heating coil 17 which in turn couples electromagnetically to the saucepan 18. The high frequency energization current generates an alternating magnetic flux of high intensity that generates eddy currents in the pan load 18 to heat it to an elevated temperature suitable for cooking.

The magnetic shield 39 is made of a magnetic metal to shield the reed switch 36 from the high frequency magnetic flux to prevent undesirable consequences which may include generation of heat in the leaf contacts and contact chatter, while at the same time to allow change in the level of magnetic flux of the upper magnet 32 to effect switching of the reed switch 36.

Since magnet 32 has a tendency to decrease its magnetic field strength due to possible heat generated therein by the high frequency magnetic flux, the use of repulsion between the upper and lower magnets 32 and 35 improves attractivity of magnet 32 to the pan load 18 and particularly prevents it from falling to the original position during cooking due to lack of sufficient magnetic attraction, and further permits the use of a pan of the type having a concave bottom wall.

Although the switching action of the reed switch is utilized to prevent and permit, respectively, energization of coil 17 by switching any part of the circuit of FIG. 1, it is advantageous to provide switching of a circuit which carries small current, i.e. the current flowing through the gate circuit of silicon-controlled rectifier 23, because of the small current capacity of the switch 36.

What is claimed is:

1. In an induction heating cooking apparatus of the type including an induction heating coil for electromagnetically coupling to a metal-based cooking vessel placed in use overlying said coil and an inverter circuit operable for supplying said coil with an ultrasonic frequency energization current to develop a time-varying magnetic field and effect electromagnetic heating of the cooking vessel, a detector comprising:

a first magnet movably disposed relative to the bottom wall of said cooking vessel and which is attracted toward and moves toward the cooking vessel when the same is positioned in use overlying said coil;

a second stationary magnet spaced from said first magnet remote from said bottom wall of said cooking vessel with its poles oriented in opposition to the orientation of poles of said first magnet to produce a repulsion therebetween sufficient to cancel the weight of said first magnet;

a reed switch positioned between said first and second magnets to open and close in response to changes in the levels of magnetic flux due to the movement of said first magnet caused by attraction between said cooking vessel and said first magnet; means defining an electric circuit for connecting said reed switch to render said inverter circuit operative when the cooking vessel is positioned overlying said coil and attracting said first magnet thereto, and to otherwise render said inverter circuit inoperative; and means for electromagnetically shielding said reed switch from the time-varying magnetic field produced by the ultrasonic frequency energization current.

2. A pan detector as claimed in claim 1, further comprising a sealed casing of a non-magnetic material, and wherein said first magnet is movably supported within said sealed casing of a non-magnetic material.

3. In an induction heating cooking apparatus of the type including an induction heating coil for electromagnetically coupling to a cooking vessel placed in use overlying said coil, a static power conversion circuit receptive in use of an excitation voltage for generating an ultrasonic frequency energization current that energizes said coil to develop a time-varying magnetic field and effect electromagnetic heating of the cooking vessel, said power conversion circuit including a solid state gate controlled switching device coupled to said induction heating coil for controlling energization of said coil, and means for generating gating pulses substantially at said ultrasonic frequency to gate said switching device into conduction to produce oscillations through said conducting switching device and said induction heating coil, a detector comprising in combination therewith:

a first magnet movably disposed relative to the bottom wall of said cooking vessel and which is attracted toward and moves toward the cooking vessel when the same is positioned in use overlying said coil;

a second stationary magnet spaced from said first magnet remote from said bottom wall with its poles oriented in opposition to the orientation of poles of said first magnet to produce a repulsion therebetween sufficient to cancel the weight of said first magnet;

a reed switch positioned between said first and second magnets to open and close in response to changes in the levels of magnetic flux due to the movement of said first magnet caused by attraction between said cooking vessel and said first magnet;

means for electromagnetically shielding said reed switch from the time-varying magnetic field produced by the ultrasonic frequency energization current; and means connecting said reed switch to said pulse generating means to render said switching device operative when the cooking vessel is positioned overlying said coil and attracting said first magnet thereto, and to otherwise render said switching device inoperative.

* * * * *